United States Patent [19]

Syukuri et al.

[11] Patent Number: 4,479,709

[45] Date of Patent: Oct. 30, 1984

[54] CLEANING METHOD FOR ELECTROPHOTOGRAPHY AND MEANS THEREFOR

[75] Inventors: Kastuhiro Syukuri; Satoshi Haneda; Masahiko Itaya, all of Hachioji, Japan

[73] Assignee: Konishiroku Photo Industry Co., Ltd., Tokyo, Japan

[21] Appl. No.: 386,341

[22] Filed: Jun. 8, 1982

[30] Foreign Application Priority Data

Jul. 24, 1981 [JP] Japan ..... 56-116595

[51] Int. Cl.[3] ..... G03G 15/08

[52] U.S. Cl. ..... 355/15; 355/3 DD; 118/652; 430/125

[58] Field of Search ..... 355/15, 3 DD, 14 D; 430/125; 118/652

[56] References Cited

U.S. PATENT DOCUMENTS

| | | | |
|---|---|---|---|
| 3,743,540 | 7/1973 | Hudson | 355/15 X |
| 4,095,980 | 6/1978 | Satomi | 355/15 X |
| 4,108,546 | 8/1978 | Rezanka | 355/15 |
| 4,233,386 | 11/1980 | Aizawa et al. | 355/15 X |

*Primary Examiner*—A. C. Prescott

*Attorney, Agent, or Firm*—Frishauf, Holtz, Goodman & Woodward

[57] ABSTRACT

A method of cleaning off a residual toner from the surface of an image forming member in an electrophotography apparatus comprises applying an alternating electric field between the surface of the image forming member and a cleaning member, for causing the residual toner to move from the surface of the image forming member to the cleaning member and to adhere on the cleaning member.

29 Claims, 3 Drawing Figures

CLEANING METHOD FOR ELECTROPHOTOGRAPHY AND MEANS THEREFOR

BACKGROUND OF THE INVENTION

1. Field of the Invention

The present invention relates to a cleaning method to remove toner attached on a surface to be cleaned from said surface and particularly to a cleaning method to be used for cleaning an image retaining member of a dry type electrophotographic copying machine wherein the visible image is formed by dry type development and said visible image is transferred on a sheet and a final copy is obtained.

2. Description of the Prior Art

Typical cleaning methods of an image retaining member used in a copying machine include a method to clean the surface of the image retaining member by wiping with a fur brush, a web, a blade and the like, a method to clean by using an air current, and a method to clean by using magnetism or a magnetic brush. The method to clean by wiping mechanically the surface of the image retaining member tends to damage the surface of the image retaining member and to cause toner filming. The cleaning means employing the brush, in particular, has a big problem of toner scattering due to the high speed rotation of said brush.

SUMMARY OF THE INVENTION

It is an object of the present invention to provide a cleaning method that does not damage the surface of an image retaining member.

It is another object of the present invention to provide a cleaning method that assures a high cleaning capability and does not cause toner filming on the image retaining member.

The above objects of the present invention are accomplished by a cleaning method for electrophotography which comprises applying an alternating electric field between the surface to be charged and a cleaning means for cleaning a residual toner from the surface of an image forming member.

Namely, the basic idea of the present invention lies in a method to clean by moving efficiently the residual toner on the surface of an image retaining member to the cleaning member by using an electric force after transferring a toner image to a sheet. The invention also resides in a cleaning method wherein a cleaning member to is held closely to the surface of the image retaining member on which the residual toner is attached and said toner is transferred to the cleaning member by using an alternating electric field.

DETAILED DESCRIPTION OF THE PREFERRED EMBODIMENTS

Figure 1:
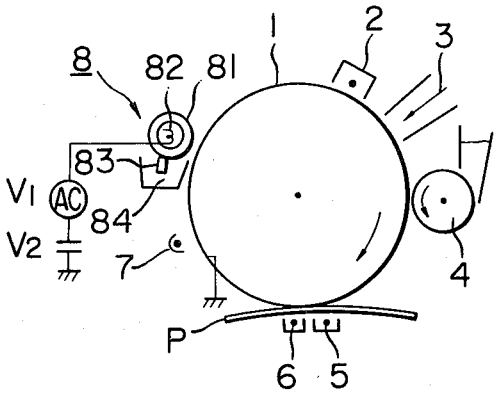
FIG. 1, FIG. 2 and FIG. 3 show respective cross-sectional views of the embodiments of the present invention.

FIG. 1 shows a copying machine wherein a cleaning method of the present invention is used. A photosensitive receptor drum 1 as an image forming or retaining member rotates in the direction of an arrow. After the peripheral surface of said photosensitive receptor drum 1 is uniformly charged by a charging means 2 and is exposed image-wisely by an exposure section 3, a latent image is formed thereon. Then, after the latent image is developed by a developing means 4, formed toner image is transferred onto a sheet P by a corona charging means for transferring 5. The sheet P carrying the toner image is separated from the photosensitive receptor drum 1 by a corona charging means for separation 6 and is conveyed to a fixing means (not illustrated).

The photosensitive receptor drum 1 whose transferring has been completed rotates to a cleaning means with a toner remaining thereon without being transferred and it is cleaned. A cleaning method of the present invention is used in the cleaning means.

A photosensitive receptor used in this example is a Se-Te photosensitive receptor with a thickness of 50μ–70μ and it rotates at the linear speed of about 150 mm/sec. The principal ingredient of the toner is a styrene-acrylic resin. The residual toner is charged in the negative polarity by a corona charging means 7 and then is carried to the cleaning means 8.

The cleaning means 8 comprises a roller 81 that rotates at the linear speed of about 100 mm/sec in the cleaning means 8. The roller 81 is adjacent photosensitive drum 1 and is made of a transparent polyacrylate resin, and a thin conductive layer is provided on the surface of the roller 81. The distance between the roller 81 and the photosensitive receptor drum 1 is kept at 1.5 mm. A LED array 82 is provided inside the roller 81 as an illuminant.

The voltage to be impressed on the conductive layer of the roller 81 is one wherein an alternating voltage V1 (2 KHz and 2 KV) is superposed on a 1 KV D.C. voltage V2. When an alternating electric field wherein the A.C. voltage is superposed on the D.C. voltage is applied with corona ions on the photosensitive receptor drum which is illuminated by the LED array 82, the toner on the photosensitive receptor drum 1 moves to the roller 81 and adheres thereon. The toner moved onto the peripheral surface of the roller 81 is scraped off by a blade 83 and the toner scraped off is collected in a recovery box 84.

In the cleaning method of the present invention applied to the copying machine of FIG. 1, it was observed that after the separation of the sheet the toner remaining on the photosensitive receptor drum moved completely to the cleaning means 8.

Figure 2:
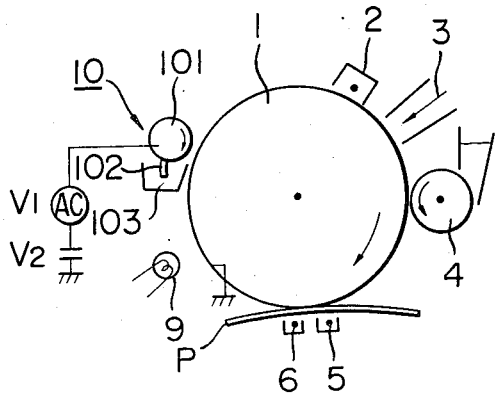

FIG. 2 shows a copying machine employing another example of the present invention and the copying machine section excluding the cleaning means thereof is exactly the same as the one in the first example.

The photosensitive receptor drum 1 having the residual toner adhered thereon is illuminated by a charge eliminating lamp 9 and thereby the electrostatic charge image is eliminated and it arrives at a cleaning means 10. In the cleaning means 10, there is provided a roller 101 which rotates at the linear speed of about 200 mm/sec and the distance between the roller 101 and the photosensitive receptor drum 1 is kept at 1 mm. The roller 101 is made of aluminum that is anodized and the voltage to be impressed on the roller 101 is an alternating voltage V1 (500 Hz and 1 KV) superposed on a D.C. voltage V2 of 1 KV. When such alternating electric field is applied, the toner on the photosensitive receptor drum 1 moves to the roller 101 and adheres thereto. The toner moved onto the peripheral surface of the roller 101 is scraped off by a blade 102 and is collected in a recovery box 103. Sufficient cleaning effects were observed even in the present example.

Figure 3:
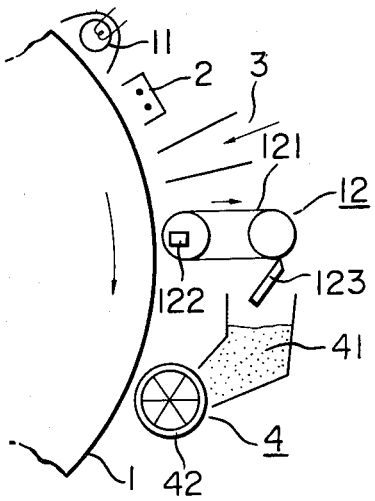

FIG. 3 shows a third example which was applied to a copying machine using a one-component magnetic toner. In this copying machine, one process is completed with two revolutions of the photosensitive receptor drum 1. A development process is made during the first revolution of said photosensitive receptor drum 1 and a cleaning process is made during the second revolution thereof.

The photosensitive receptor drum 1 rotates in the direction of an arrow and the surface of said drum 1 is illuminated by a charge eliminating lamp 11 that is lit only for the cleaning process. After the electrostatic charge image thereon is eliminated, it is cleaned at a cleaning means 12. In the cleaning means 12, there is provided a non-magnetic metallic endless belt 121, and said endless belt is impressed an alternating voltage V1 (1 KHz and 1 KV) superposed on a D.C. voltage V2 of 700 V. Both the photosensitive receptor drum 1 and the belt 121 rotates with a linear speed of 150 mm/sec and they are spaced by a distance of 0.5 mm at the position where the photosensitive receptor drum 1 and the belt 121 are located with a shortest distance. Inside the belt 121, there is provided a permanent magnet 122 near the photosensitive receptor drum 1. When an alternating electric field is applied as described above, the toner on the photosensitive receptor drum is given a magnetic force and flies off to move and adhere on the belt 121. The toner moved to the peripheral surface of the belt 121 is scraped off by a blade 123 and is recovered in a toner supplying section 41 positioned at the upper part of a developing means 4.

Sufficient cleaning effect was observed in the present example and at the same time the effect that the recycling of the toner may extremely easily be done was observed. Incidentally, the cleaning means 12 of the present invention was separately provided with the developing means 4 on the peripheral surface of the photosensitive receptor drum 1 but in the copying machine with a two-revolution system, it is possible to use the developing means 4 for two purposes of development and cleaning. Namely, in the process of cleaning, it is possible to obtain the cleaning effect even by applying a biased alternating electric voltage of the present invention on a cylindrical developing sleeve 42 of the developing means 4.

With the present example, extremely efficient and sufficient cleaning is possible owing to the synergism of a mechanical sweeping function by the magnetic brush and a cleaning function by the electric force.

The present inventors explained above the 3 examples of the present invention, and larger and surer effects of the present invention may be obtained by using the method explained below.

(1) Cleaning effects may be further increased by charging toner on an image forming member by a corona charging means before the cleaning and/or eliminating corona ions on the image forming member by illumination. When a corona charging process and an illumination process are combinedly used, it is preferably that the corona charging process is made first and then the illumination process is made later. Thereby, the toner tends to move from the image forming member to a cleaning means. Further, as the first example shows, it is also effective that the illumination process and the cleaning process are made simultaneously.

(2) A biased alternating electric field to be impressed may be of any one of a pulse wave, a square wave or a sine wave. D.C. voltage is of an opposite electrostatic characteristic against the toner and 50 V–2 KV with a positive or negative polarity is applied. Alternating voltage with ±100 V–±4 KV and a frequency of 50 Hz–50 KHz is used and the superposed alternating electric voltage produces a field which makes the flying of toner easy and increases the cleaning effect.

(3) The distance between a cleaning member and its adjacent image forming member 1 is preferably 0.1 mm–5 mm and about 2 mm is most preferable. However, the cleaning effect may be obtained even by applying the biased alternating electric field with a conductive elastic roller that is insulation-covered and which contacts the adjacent image forming member and is rotated.

(4) The cleaning member may basically be made of a conductive member because voltage is impressed thereto. A metallic roller is preferable from the view point of accuracy. Since high voltage is impressed between the cleaning member and the image retaining member, a thin insulation coating such as resin coating or an oxidized coating is provided on the surface of said cleaning member.

(5) It is desirable that the cleaning member is an endless belt or a roller because it needs to be of a rotatable structure. The direction of the rotation is not regulated in particular.

(6) Toner on the cleaning member is removed by a cleaning blade such as a rubber blade, a mylar blade or a metal blade or plate. The blade may be maintained at the same voltage level as the cleaning member.

(7) When a one component magnetic toner is used, it is effective that a permanent magnet is arranged at the cleaning means and a magnetic force is used together with an electrostatic force. When a two component developer is used, it is effective for removing the carrier of iron powder. In this case, a magnetic bias is applied to the magnetic toner or the developer by the permanent magnets and therefore there is included an alternating component only and a D.C. component is not included as an electric bias. Namely, an alternating voltage that is not biased may be applied.

What is claimed is:

1. In an electrophotography apparatus, an improved cleaning means for removing a residual toner from the surface of an image forming member, said cleaning means being located downstream of a toner transferring area, said cleaning means comprising:

a conductive cleaning member arranged adjacent said image forming member; and means for applying an alternating electric field between said conductive cleaning member and said surface of the image forming member for causing said residual toner on said surface of the image forming member to move off of said surface and to adhere onto said conductive cleaning member under the influence of forces applied to said residual toner by said alternating electric field; and illuminating means for illuminating the surface of said image forming member after transferring of a toner image to a recording medium and said alternating electric field is applied so as to eliminate the charge on the illuminated surface portion of said image forming member to facilitate said moving off of said residual toner under the influence of said alternating electric field.

2. A cleaning means according to claim 1, wherein said cleaning means further comprises a cleaning blade for scraping off the toner from said conductive cleaning member.

3. A cleaning means according to claim 1, wherein said conductive cleaning member is a hollow roller, the surface being provided with a conductive layer, and said alternating electric field is applied to the conductive layer.

4. A cleaning means according to claim 3, wherein said cleaning means further comprises a charging means for charging the residual toner on the surface of the image forming member before applying said alternating electric field.

5. A cleaning means according to claim 1, wherein said conductive cleaning member comprises a conductive roller.

6. A cleaning means according to claim 1, wherein said conductive cleaning member comprises a conductive endless belt extending over at least two rollers and said alternating electric field is applied to the conductive endless belt.

7. A cleaning means according to claim 6, wherein said cleaning means includes a magnet provided within said endless belt for attracting the residual toner on the surface of the image forming member.

8. A cleaning means according to claim 1, wherein said conductive cleaning member comprises a cylindrical developing sleeve for developing a latent image formed on the image forming member to obtain a visible image and a magnet provided within said sleeve.

9. A cleaning means according to claim 1, wherein said cleaning member and said surface of the image forming member are spaced from each other.

10. A cleaning means according to claim 9, wherein said spacing is about 0.1 to about 5 mm.

11. A cleaning means according to claim 10, wherein said spacing is about 2 mm.

12. A cleaning means according to claim 1, wherein said means for applying an alternating electric field comprises means coupled to said conductive cleaning member for applying an alternating voltage to said conductive cleaning member.

13. A cleaning means according to claim 1, wherein said means for applying an alternating electric field comprises a means coupled to said conductive cleaning member for applying a D.C. biased alternating voltage to said conductive cleaning member.

14. A cleaning means according to claim 1, wherein the top of a toner layer on said conductive cleaning member is arranged so as to be spaced from said image forming member.

15. A cleaning means according to claim 14, wherein said electrophotography apparatus comprises a developing means using toner only.

16. A cleaning means according to claim 1, wherein said electrophotography apparatus comprises a developing means using toner only.

17. A cleaning means according to claim 2, wherein said cleaning blade is in contact with said conductive cleaning member.

18. A cleaning means according to claim 14, wherein said cleaning means further comprises a cleaning blade in contact with said conductive cleaning member for scraping off toner from said conductive cleaning member.

19. A method of cleaning off a residual toner from the surface of an image forming member in an electrophotography apparatus which comprises:

illuminating the surface of said image forming member after transferring of a toner image to a recording medium to substantially eliminate the charge on the illuminated surface portion of said image forming member; and thereafter applying, downstream of the toner transfer area and after said illuminating of said surface of said image forming member, an alternating electric field between said surface of said image forming member and a cleaning member arranged adjacent said image forming member for causing said residual toner to move off from said surface of said image forming member to said cleaning member and to adhere onto said cleaning member under the influence of forces applied to said residual toner by said alternating electric field.

20. A cleaning method according to claim 19, wherein said method further comprises charging the residual toner on the surface of the image forming member before applying said alternating electric field.

21. A cleaning method according to claim 19, wherein said cleaning member and said surface of the image forming member are spaced from each other.

22. A cleaning method according to claim 21, wherein said spacing is about 0.1 to about 5 mm.

23. A cleaning method according to claim 22, wherein said spacing is about 2 mm.

24. A cleaning method according to claim 19, wherein said step of applying said alternating field comprises applying an alternating voltage to said cleaning member.

25. A cleaning method according to claim 19, wherein said step of applying said alternating field comprises applying a D.C. biased alternating voltage to said cleaning member.

26. A cleaning method according to claim 19; wherein the top of a toner layer on said cleaning member is arranged so as to be spaced from said image forming member.

27. A cleaning method according to claim 26, wherein said electrophotography apparatus comprises a developing means using toner only.

28. A cleaning method according to claim 19, wherein said electrophotography apparatus comprises a developing means using toner only.

29. A cleaning method according to claim 19, comprising arranging a toner scraping member in contact with said cleaning member so as to scrape toner off of said cleaning member.

* * * * *